US008212760B2

(12) United States Patent
Creusen et al.

(10) Patent No.: US 8,212,760 B2
(45) Date of Patent: Jul. 3, 2012

(54) DIGITAL DRIVING METHOD FOR LCD PANELS

(75) Inventors: Martin Creusen, Wÿlre (NL); Ronald Bartels, Brunssum (NL)

(73) Assignee: Chimei Innolux Corporation, Miao-Li County (TW)

( * ) Notice: Subject to any disclaimer, the term of this patent is extended or adjusted under 35 U.S.C. 154(b) by 936 days.

(21) Appl. No.: 11/780,216

(22) Filed: Jul. 19, 2007

(65) Prior Publication Data

US 2009/0021464 A1 Jan. 22, 2009

(51) Int. Cl.
*G09G 3/36* (2006.01)

(52) U.S. Cl. ..... 345/100; 345/102; 345/89; 345/204; 345/208; 345/94; 349/72; 349/85

(58) Field of Classification Search ..... 345/100, 345/98, 204, 87, 89, 92, 94, 102, 208, 690, 345/691; 349/72, 85, 173
See application file for complete search history.

(56) References Cited

U.S. PATENT DOCUMENTS

| | | | | |
|---|---|---|---|---|
| 7,038,654 | B2 * | 5/2006 | Naiki et al. | 345/101 |
| 7,466,300 | B2 * | 12/2008 | Naiki et al. | 345/101 |
| 7,911,430 | B2 * | 3/2011 | Fujine | 345/89 |
| 2001/0040548 | A1 * | 11/2001 | Ikeda | 345/92 |
| 2002/0008688 | A1 * | 1/2002 | Yamamoto et al. | 345/98 |
| 2003/0117362 | A1 * | 6/2003 | An | 345/98 |
| 2004/0041762 | A1 * | 3/2004 | Naiki et al. | 345/87 |
| 2005/0083287 | A1 * | 4/2005 | Yamazaki et al. | 345/92 |
| 2005/0093809 | A1 * | 5/2005 | Lim | 345/100 |
| 2006/0028423 | A1 * | 2/2006 | Hsu et al. | 345/101 |
| 2006/0158410 | A1 * | 7/2006 | Fujine | 345/89 |
| 2006/0256142 | A1 * | 11/2006 | Sagano et al. | 345/690 |
| 2008/0170027 | A1 * | 7/2008 | Kyeong et al. | 345/100 |
| 2008/0316163 | A1 * | 12/2008 | Van Den Homberg et al. | 345/98 |

FOREIGN PATENT DOCUMENTS

| | | | |
|---|---|---|---|
| CN | 1428757 | A | 7/2003 |
| TW | I261136 | B | 9/2006 |
| WO | 2006092757 | A2 | 9/2006 |

* cited by examiner

*Primary Examiner* — Lun-Yi Lao
*Assistant Examiner* — Priyank Shah
(74) *Attorney, Agent, or Firm* — Morris Manning & Martin LLP; Tim Tingkang Xia, Esq.

(57) ABSTRACT

A liquid crystal display (LCD) with a driver IC and an LCD panel having source and gate lines. A gate driver is disposed in the LCD panel for sequentially supplying scan signals to the gate lines of the panel. A source driver in the driver IC converts pixel data into an analog source signal and supplies the signal to the source lines. A lookup table is stored with a mapping of possible luminance values for pixels of the LCD panel onto at least one luminance control parameter. The source driver converts the pixel data so that a voltage of the analog source signal increases during a gate scan period depending on the luminance control parameter in such a way that at the end of the gate scan period a voltage at a corresponding pixel electrode is equal to an analog value corresponding to the pixel data.

10 Claims, 4 Drawing Sheets

DIGITAL DRIVING METHOD FOR LCD PANELS

TECHNICAL FIELD

The present invention generally relates to a liquid crystal display (LCD) module, and more specifically to an apparatus and method for driving LCD panels.

BACKGROUND

The transmittance of pixels in an LCD panel is determined by an analog voltage applied on the corresponding pixel electrodes. For example, in case of a typical twisted nematic optical configuration with crossed polarizers, a voltage difference of 5 Volt across the pixel electrodes results in a black state for the pixel, whereas a voltage difference of 1 Volt or lower, results in a white state for the pixel. The pixel voltages are generated by supplying the required voltage levels on the source bus lines (also known as data lines) which are connected to the pixel electrodes via Thin Film Transistors (TFTs). Conventionally, after a long settling time as determined by the resulting RC-time of source bus line/TFT/pixel structure, the voltage on the source bus line is "copied" onto the pixel electrode.

Before the analog voltage can be supplied on the source bus line, the original digital input signal needs to be converted to an analog voltage level by using a Digital-to-Analog Converter (DAC). The DAC can be positioned on a driver IC, e.g. for a-Si panels, but the DAC can also be positioned on an array glass of the LCD panel, e.g. in case of highly integrated Low Temperature Poly Silicon (LTPS) panels.

Disadvantages of the above-mentioned DAC implementations are:

1. The required minimum charging time is limited by the RC time of the source bus line/TFT/pixel structure. An increase of the panel resolution to, e.g. QVGA or higher, further reduces the available pixel charging time which can lead to incorrect pixel voltage levels (i.e. the pixels do not charge completely up to a required voltage level). In case of LTPS panels, increasing the multiplexing rate, e.g. from 1:3 to 1:6, can further reduce the available pixel charging time.

2. Implementing the DAC on the array glass requires quite a large area which increases the panel outline and consequently the module outline. Because customers will require modules with a smaller footprint, the required DAC area is a limiting bottleneck. Besides, a larger panel outline may reduce the number of panels per bipane increasing the panel cost.

3. Implementing the DAC in the driver IC increases the required voltage levels of the IC and consequently such will increase the IC-cost. For example, the maximum DAC output will typically be around ~5V, whereas the maximum voltage available in a low cost digital submicron IC (e.g. 0.13 or 0.18 μm) is typically less than 2.5 V.

SUMMARY

Accordingly, an object of the present invention is to provide an LCD panel in which source lines are driven without the use of a DAC circuit.

In order to attain the above and other related objects for the present invention, there is provided an LCD panel with a plurality of gate and source lines arranged in a matrix form, and a thin film transistor and a pixel electrode disposed at each crossing of the gate and source lines such that an image is displayed on the LCD panel according to scan signals supplied through the gate lines and analog source signals supplied through the source lines. A gate driver is included for sequentially supplying the scan signals to the gate lines of the liquid crystal display panel. A source driver is used for converting inputted digital pixel data into an analog source signal and supplying the analog source signal to one of the source lines.

The LCD panel further includes a lookup table with a mapping of possible luminance values for pixels of the liquid crystal display panel onto at least one luminance control parameter (e.g. $\alpha$, $\Delta$), the source driver being arranged to convert the inputted pixel data so that a voltage V(t) of the analog source signal increases during a gate scan period depending on the at least one luminance control parameter (e.g. $\alpha$, $\Delta$) and in such a way that at the end of the gate scan period a voltage at a corresponding pixel electrode is equal to an analog value corresponding to the inputted pixel data. Please note that the term "luminance values" mentioned above refers to luminance values for full transmissive panels and to reflectance values for panels including a reflective component.

By applying a voltage to a source line that results at the end of a gate scan period in a required luminance of a pixel, and by storing a required (i.e. an appropriate) charging time in a LUT, one can drive the pixels without the use of a DAC. Furthermore, no settling time is required, and therefore making the driving of the pixels considerably faster than the known methods.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will be discussed in more detail below, using a number of exemplary embodiments, with reference to the attached drawings, in which.

DETAILED DESCRIPTION OF EXEMPLARY EMBODIMENTS

Figure 1:
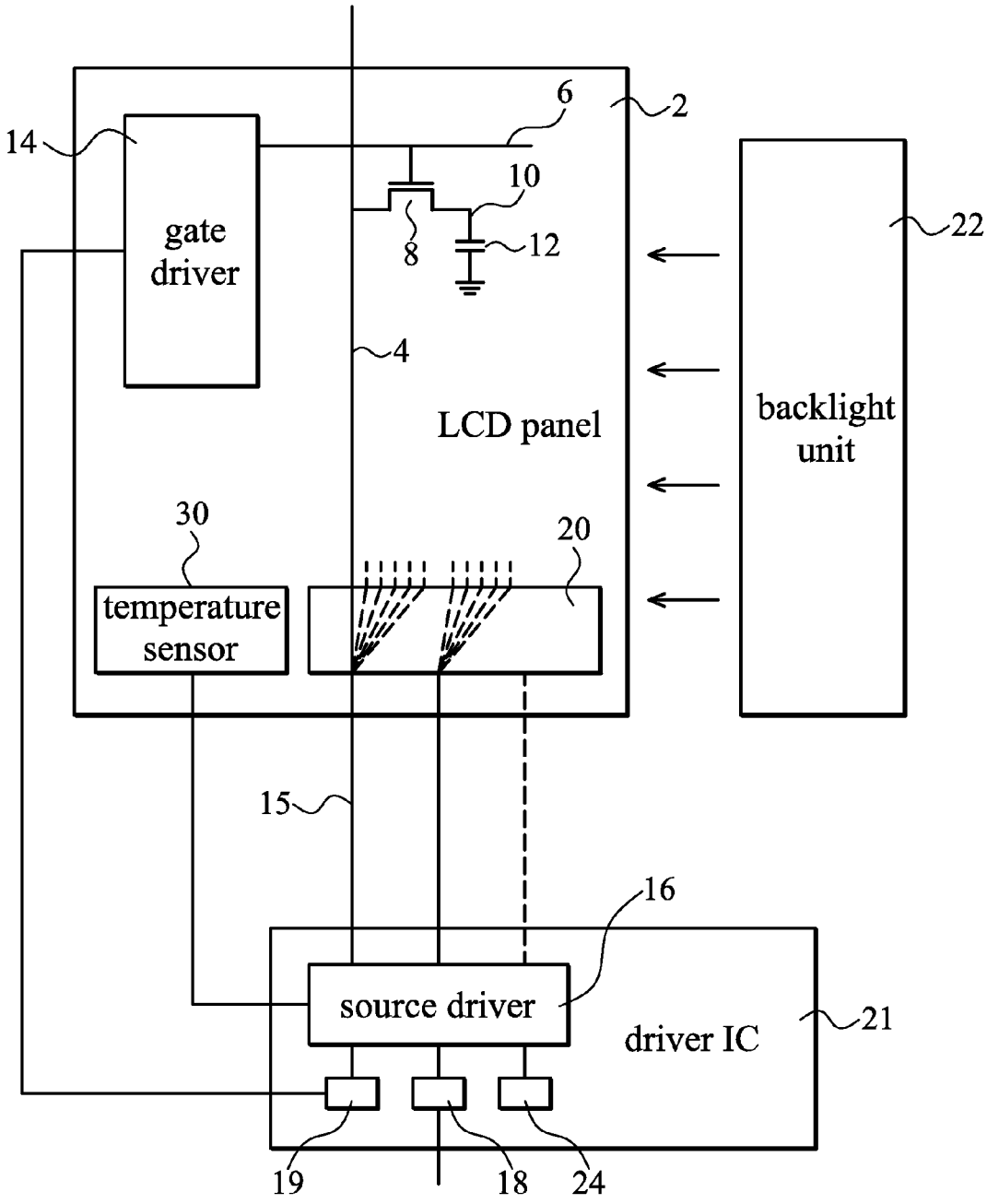
FIG. 1 is an schematic diagram showing an LCD panel with gate lines and source lines.

FIG. 1 schematically shows a part of the LCD that includes an LCD panel 2 with a gate line 6 and source line 4 arranged so as to cross each other. At each crossing of the gate line 6 and source line 4, a thin film transistor 8 and a pixel electrode 10 is disposed thereto. FIG. 1 also shows a capacitor 12 representing the capacitance of the corresponding pixel. An image can be displayed on the LCD panel 2 according to scan signals supplied through the gate line 6 and analog source signals supplied through the source line 4.

The LCD panel further includes a gate driver 14, either in the driver IC or on the array glass, for sequentially supplying the scan signals to the gate line 6 of the LCD panel 2. The scan signals are consisted of pulses of which a pulse width determines the period of which the thin film transistor 8 is turned "on" (i.e. the transistor has a low resistance). During this period, the pixel electrode 10 is connected to an output line 15 from a source driver 16. The period of which the thin film transistor 8 is turned "on" is also referred to as a "gate scan period". The source driver 16 converts inputted pixel data into analog source signals and supplying the analog source signals to the source lines 4 via the output line 15. The inputted pixel data is received either via an interface 18 connected with a supplying host (e.g. base band processor) or via a frame memory (not shown) implemented in a driver IC 21.

In the embodiment as illustrated in FIG. 1, the LCD panel also has a demultiplexer 20 which is used to drive multiple source lines 4 using the single source driver output line 15. Also a timer 19 is added to the driver IC 21 in order to send a clock signal to both the source driver 20 and the gate driver 14. By sending clock signals, the timer 19 will synchronise the source driver 16 and the gate driver 14. A backlight unit 22 is provided for illumination of the LCD panel 2. The LCD panel 2 and the backelight unit 22 can form a portion of a display system. The display system can be a personal digital assistant (PDA), a notebook computer (NB), a personal computer (PC), digital camera, car display, global positioning system (GPS), avionics display or a mobile phone.

Additionally, the source driver 16 is arranged to convert the inputted pixel data so that a voltage V(t) of the analog source signals (i.e. on the output line 15) increases during a gate scan period such that at the end of the gate scan period, a voltage at the pixel electrode 10 is equal to an analog value corresponding to the inputted pixel data. The increase of the voltage V(t) is dependant on at least one luminance control parameter, the value of which is stored in a Lookup Table (LUT) 24. The LUT 24 stores a mapping of possible luminance values for pixels of the liquid crystal display panel 2 onto at least one luminance control parameter.

Figure 2:
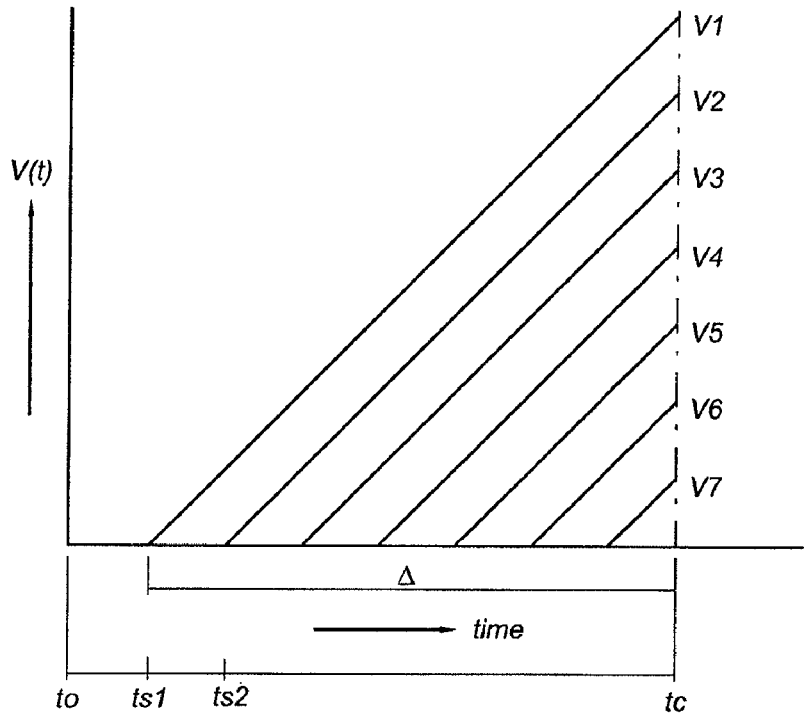
FIG. 2 is a graph showing a potential increase of a source line supplying voltage.

In the embodiment as shown in FIG. 2, the voltage V(t) increases linearly with time during a required supplying time Δ. Values for the required supplying time Δ are stored in the LUT 24. In FIG. 2, the voltage V(t) increases from a starting time $t_s$ (such as $t_{s1}$, $t_{s2}$, etc.) until a closing time $t_c$. The starting time $t_s$ is delayed with respect to the beginning of the pulse of the scan signal on the gate line 6, i.e. $t_0$. At $t_c$ the voltage on the pixel electrode 10 is at such a level that it produces the luminance value wanted. Different delays result in different end voltages (V1, . . . V7).

Figure 3:
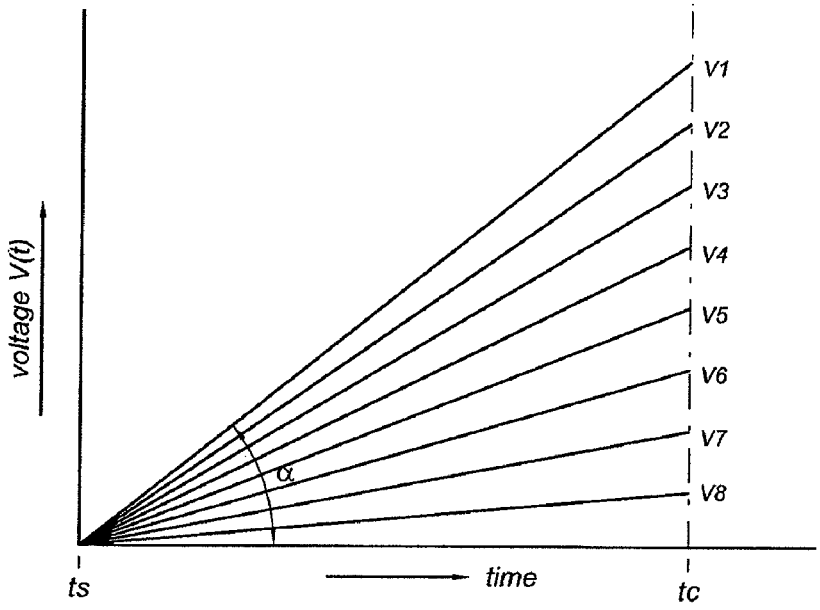
FIG. 3 is a graph showing another potential increase of a source line supplying voltage.

According to another embodiment as shown in FIG. 3, the voltage V(t) increases linearly with a slope a which is stored in the LUT 24 in relation with a wanted luminance value. FIG. 3 also illustrates examples of V(t) wherein different slopes α result in different end voltages (V1, . . . V7).

Figure 4:
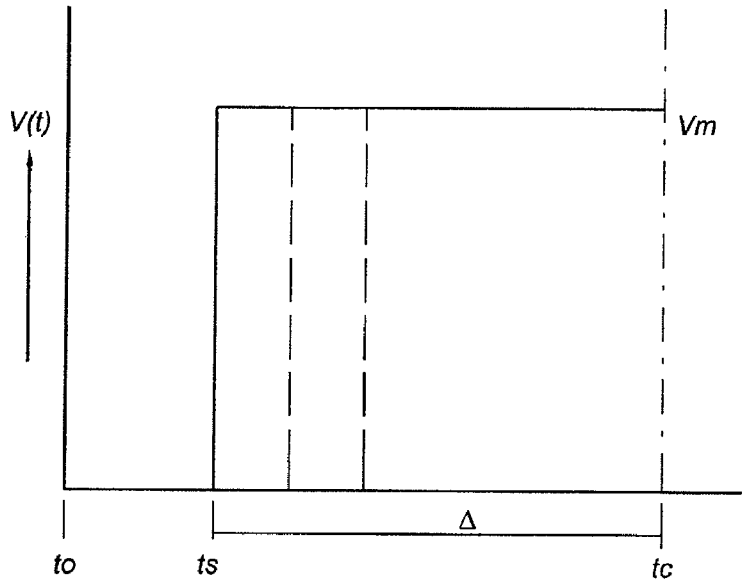
FIG. 4 is a graph showing a further potential increase of a source line supplying voltage.

FIG. 4 shows the supplying voltage V(t) as a function of time according to yet another embodiment. The voltage V(t) has a maximum value $V_m$ and has the form of a step function, the width of which is modulated by a required supplying time period which is stored in the LUT 24. Alternatively, the maximum voltage $V_m$ of the pulse may be stored in the LUT 24, or both the maximum voltage $V_m$ and the required supplying time maybe stored in the LUT 24.

In the embodiments described above, the required supply time Δ (i.e. $t_c$-$t_s$) may be considerable shorter than the gate scan period. A typical example of a gate scan period is 52 μsec (for 60 Hz, 320 gate lines), while typical values for the supply times in the embodiments of the invention vary between 3-5 μsec. The reason for this considerable shortening of supply time results from the fact that due to the use of the LUT 24, the maximum values V1-V7 of the voltage V(t) can be (much) higher than the final pixel electrodes. This results in a relatively fast increase of the pixel electrode voltages. However, the maximum value V1-V7, or $V_M$ will not be reached because the voltage V(t) is cut off at the closing time $t_c$. At $t_c$ the scan pulse ends and the gate of the TFT 8 closes. This will be discussed in more detail with reference to FIG. 5 in which the voltage V(t) increases linear as was shown in FIG. 2.

Figure 5:
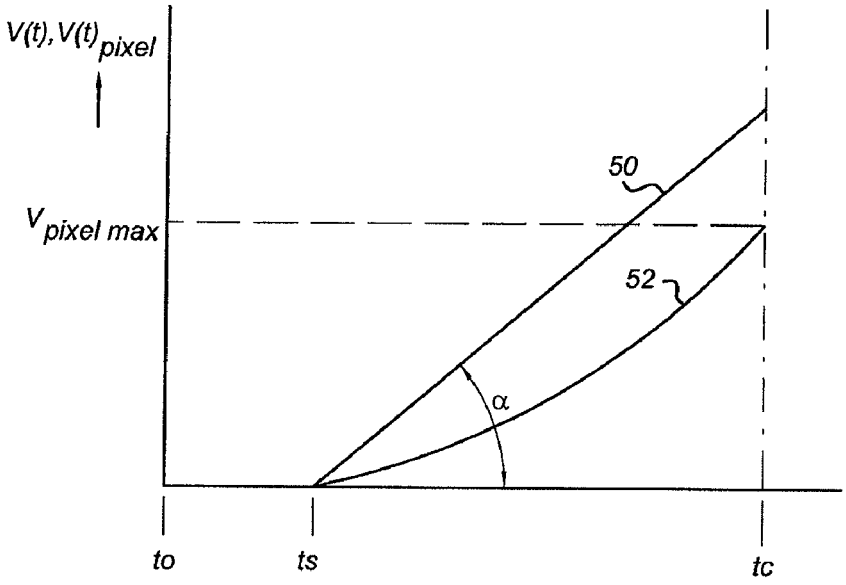
FIG. 5 is a graph showing an example of a supplying voltage together with a pixel electrode voltage as a function of time.

In FIG. 5, the line 50 depicts the increasing voltage V(t) and the resulting pixel electrode voltage $V_{PIXEL}$ is indicated with number 52. Due to an RC-time delay of the so-called panel load (i.e. the source line plus the pixel impedance), the voltage $V_{PIXEL}$ is not directly following the voltage V(t). At time $t_c$ the pixel electrode voltage $V_{PIXEL}$ reaches a value $V_{PIXELmax}$ which results in a luminance value Lmax (i.e. in this example a possible voltage offset due to a parasitic kick-back phenomenon of the TFT is not taken into account). The value Lmax is actually the required luminance of the pixel involved. In fact, a digital value for this luminance was inputted to the source driver 16 and converted to a required supplying time ($t_s$-$t_c$) and/or the required slope α. using the LUT 24. The mappings in the LUT 24 can be determined by calibration or simulation. Every possible luminance value for a certain panel type can be translated in advance into an associated voltage V(t), the luminance control parameter values of which being stored in the LUT 24.

Figure 6:
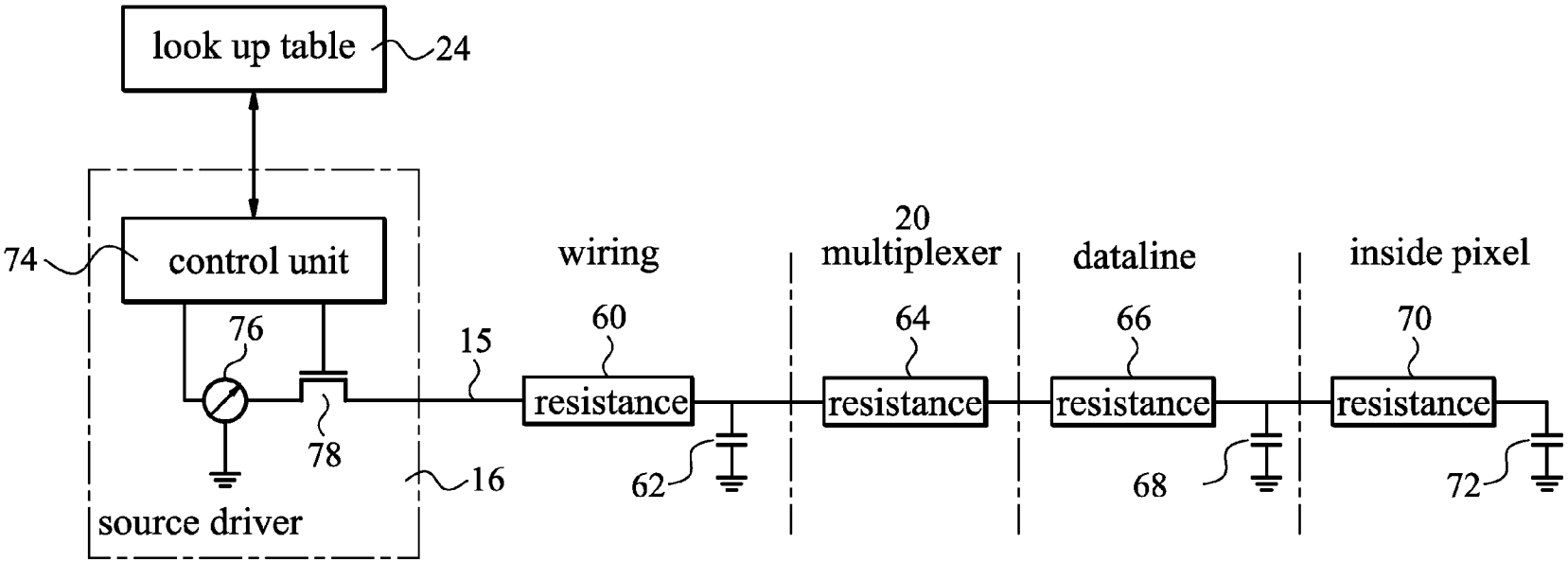
FIG. 6 is an exemplary diagram showing an embodiment of the source driver together with a source line and a pixel.

A possible implementation of the source driver 16 and the LUT 24 for driving a source line is shown in FIG. 6. The source line is schematically shown as an electronic circuit to elucidate the impedance of the components of the source line and the pixel. The output line 15 of the source driver 16 is connected to the multiplexer 20 via wiring that has an resistance 60 and a capacitance 62. The multiplexer 20 itself has a resistance 64. The data line (i.e. the source line 4) has a resistance 66 and a capacitance 68. The pixel has a resistance 70 and a capacitance 72. In FIG. 6, the capacitances are connected to ground as indicated by a triangle.

The source driver 16 has a control unit 74 which is arranged to access the LUT 24. The control unit 74 is also arranged to receive inputted pixel data (i.e. digital data) from either via an interface 18 connected with the supplying host (e.g. base band processor) or via the frame memory implemented in the driver IC. The source driver has a current source 76 and a switch 78. In this embodiment, the control unit 74 can control the current source 76 and switch 78. The bias current of the current source can be set depending on a value retrieved from the LUT 24. The moment the switch must be opened can be determined by retrieving a value for the required supplying time. It should be clear to the skilled reader that instead of a required supplying time (i.e. a time period), a starting time $t_s$ may be stored in the LUT 24.

In the embodiments described above, the required pixel voltage levels are not defined through any DAC. Instead, the pixel voltage levels are defined by selecting the time of which a specific voltage or current is applied on the source bus lines 4 and/or by selecting the appropriate maximum value for the voltage or current. This implementation does not require a change in gate driving as all TFTs 8 in one row of the LCD panel 2 will be closed simultaneously. The final pixel voltage levels may be defined by changing a bias current of output buffers of the source driver 16. It is noted that the source driver 16 can be implemented apart from the driver IC 21, or directly into a glass array of the LCD panel 2. Similarly, the multiplexer 20 can be implemented directly into the glass array, or in a separate IC or driver IC 21.

According to a further embodiment, the source driver 16 is arranged to output a reset signal before outputting the analog source signal. The pixel capacitance 72 may vary for different pixel voltages. A "reset" phase before driving the pixels will set all pixels in one gate line to the same state (e.g. mid-grey transmission state). In this way, all pixels will have the same capacitance before they are driven and no additional compensation for the voltage dependency of the capacitance is needed.

The pixel voltage accuracy is determined by the RC uniformity across the LCD panel 2 (e.g. transmission line formed IC-buffer output, source bus, TFT, pixel etc.). In case the RC uniformity is not sufficient, the RC non-uniformity can be analyzed during the panel initialization and stored in an "offset-cancellation" Table. Based on the values in this Table, the values of the LUT 24 will get a certain offset to cancel out the RC non-uniformities as determined during the panel initialization.

In yet another embodiment, the liquid crystal display includes a temperature sensor 30. The source driver 16 can be arranged to receive input from the temperature sensor 30, and output the analog source signal in dependency of the input (i.e. the temperature). By digitally compensating the temperature-induced shift in the driving scheme, changes in RC-behavior versus temperature can be bypassed.

In the present invention, no DAC is used and the digital pixel data are directly applied to determine the source line voltage. This driving method is named "digital driving", and advantages of the "digital driving" are discussed henceforth:

1) No DAC is required either on the array glass or in the driver IC. Such will reduce either IC cost and/or panel outline dimensions.

2) The input data signal can be converted in the "digital" domain into time (e.g. amount of delay). Such simplifies the total electrical architecture significantly.

3) The minimum charging time is reduced as no "settling" time is required to stabilize the voltage on the pixel. Such enables higher LTPS multiplexing ratios (i.e. impacts IC cost) and/or higher panel resolutions.

4) The LC response speed is reduced as a result of the reset function (i.e. all grey-to-grey level response speeds will be equal).

5) The power consumption is reduced (e.g. no DAC, no resistor string required).

The present invention has been explained above with reference to a number of exemplary embodiments. As will be apparent to the person skilled in the art, various modifications and amendments can be made without departing from the scope of the present invention, as defined in the appended claims.

The invention claimed is:

1. A liquid crystal display module comprising:

a liquid crystal display panel, said panel comprising:

a plurality of gate and source lines arranged in a matrix form with crossing points, a thin film transistor and a pixel electrode disposed at each of said crossing points of the gate and source lines, an image being displayed on the liquid crystal display panel according to scan signals supplied through the gate lines and analog source signals supplied through the source lines, and a gate driver for sequentially supplying the scan signals to the gate lines of the liquid crystal display panel; and a driver circuit, said circuit comprising:

a source driver for converting inputted pixel data into an analog source signal and supplying said analog source signal to one of said source lines; and a lookup table with a mapping of potential luminance values for pixels of said liquid crystal display panel onto at least one luminance control parameter ($\alpha$), wherein said source driver is arranged to convert said inputted pixel data so that a voltage V(t) of said analog source signal is increased during a gate scan period depending on said at least one luminance control parameter ($\alpha$), and in such a way that at the end of said gate scan period, a voltage at a corresponding pixel electrode is equal to an analog value corresponding to said inputted pixel data;

wherein said voltage V(t) of said analog source signal is a linearly increased voltage during a required supplying time period ending at the end of said gate scan period, and wherein said at least one luminance control parameter has an adjustable slope ($\alpha$) of said linear increasing voltage.

2. The liquid crystal display according to claim 1, wherein said source driver is arranged to output a reset signal before outputting said analog source signal.

3. The liquid crystal display according to claim 1, wherein said liquid crystal display comprises a temperature sensor, said source driver being arranged to receive input from said temperature sensor, and to output said analog source signal in dependency of said input.

4. A liquid crystal display module having no digital-to-analog converter, said module comprising:

a liquid crystal display panel; and a driver circuit coupled to said panel, wherein said panel has gate lines and a source lines, at least one of said gate lines providing a scan signal and at least one of said source lines providing an analog source signal, and a gate driver for sequentially providing the scan signal to one of the gate lines, and wherein said driver circuit has a source driver for converting pixel data into said analog source signal and providing said analog source signal to one of said source lines;

wherein said driver circuit further comprises a lookup table with a mapping of potential luminance values for pixels of said liquid crystal display panel onto at least one luminance control parameter ($\alpha$);

wherein said source driver is arranged to convert said inputted pixel data so that a voltage V(t) of said analog source signal is increased during a gate scan period depending on said at least one luminance control parameter ($\alpha$), and at the end of said gate scan period, a voltage at a corresponding pixel electrode is equal to an analog value corresponding to said inputted pixel data;

wherein said voltage V(t) of said analog source signal is a linearly increased voltage during a required supplying time period ending at the end of said gate scan period, and wherein said at least one luminance control parameter has an adjustable slope ($\alpha$) of said linear increasing voltage.

5. The module according to claim 4, wherein said panel further comprises a demultiplexer for driving one or more of said source lines.

6. The module according to claim 4, wherein said panel further comprises a temperature sensor for controlling said analog source signal through an input signal to said source driver.

7. The module according to claim 4, wherein said driver circuit further comprises a lookup table for storing a mapping of luminance values for pixels of the LCD panel.

8. The module according to claim 4, wherein said driver circuit further comprises a timer for providing a clock signal to said source driver and said gate driver.

9. A display system, comprising: an LCD display module as in claim 4; a lighting unit operably configured to generate an illuminating light towards said display module.

10. The display system according to claim 9, wherein the display system is a personal digital assistant (PDA), a notebook computer (NB), a personal computer (PC), digital camera, car TV, GPS, avionics display or a mobile phone.

* * * * *